US010490907B2

(12) United States Patent
Feldman et al.

(10) Patent No.: US 10,490,907 B2
(45) **Date of Patent: *Nov. 26, 2019**

(54) SUPPRESSION OF SURFACE WAVES IN PRINTED CIRCUIT BOARD-BASED PHASED-ARRAY ANTENNAS

(71) Applicant: Google Inc., Mountain View, CA (US)

(72) Inventors: Arnold Feldman, San Francisco, CA (US); Leesa Marle Noujelm, Los Altos, CA (US); Michael J. Buckley, Marion, IA (US)

(73) Assignee: Google LLC, Mountain View, CA (US)

( * ) Notice: Subject to any disclaimer, the term of this patent is extended or adjusted under 35 U.S.C. 154(b) by 263 days.

This patent is subject to a terminal disclaimer.

(21) Appl. No.: 15/277,149

(22) Filed: Sep. 27, 2016

(65) Prior Publication Data

US 2018/0090851 A1 Mar. 29, 2018

(51) Int. Cl.

| | |
|---|---|
| ***H01Q 21/06*** | (2006.01) |
| ***H01Q 1/12*** | (2006.01) |
| ***H01Q 1/42*** | (2006.01) |
| ***H01Q 1/48*** | (2006.01) |
| ***H01Q 5/20*** | (2015.01) |
| ***H01Q 9/04*** | (2006.01) |

(52) U.S. Cl.

CPC ..... *H01Q 21/065* (2013.01); *H01Q 1/12* (2013.01); *H01Q 1/42* (2013.01); *H01Q 1/48* (2013.01); *H01Q 5/20* (2015.01); *H01Q 9/0407* (2013.01)

(58) Field of Classification Search

CPC .. H01Q 21/065; H01Q 21/24; H01Q 21/0087; H01Q 21/0075; H01Q 15/008; H01Q 1/42; H01Q 1/12; H01Q 9/0407; H01Q 1/48; H01Q 5/20

See application file for complete search history.

(56) References Cited

U.S. PATENT DOCUMENTS

| | | | |
|---|---|---|---|
| 6,972,729 | B2 | 12/2005 | Wang |
| 7,986,279 | B2 | 7/2011 | Bruno et al. |
| 8,179,204 | B2 | 5/2012 | O'Connell et al. |

(Continued)

OTHER PUBLICATIONS

International Search Report and Written Opinion for the related Applicaton No. PCT/US2017/050376 dated Nov. 29, 2017.

(Continued)

*Primary Examiner* — Hai V Tran
*Assistant Examiner* — Michael M Bouizza
(74) *Attorney, Agent, or Firm* — Honigman LLP

(57) ABSTRACT

A phased-array antenna includes an antenna layer of a stacked printed circuit board, a ground plane layer of the stacked printed circuit board spaced apart from the antenna layer, and a first dielectric layer of the stacked printed circuit board disposed between and in opposed contact with the antenna layer and the ground plane layer. The antenna layer includes an associated metal patch pattern defined by a series of slots. The stacked printed circuit board defines a thickness extending between a top end of the stacked printed circuit board and a bottom end of the stacked printed circuit board. The phased-array antenna includes a series of ground vias extending between the top and bottom ends of the stacked printed circuit board. The ground vias are configured to suppress surface waves propagating across the stacked printed circuit board.

16 Claims, 12 Drawing Sheets

(56) References Cited

U.S. PATENT DOCUMENTS

| | | | | |
|---|---|---|---|---|
| 8,325,093 | B2 | 12/2012 | Holland et al. | |
| 2010/0039339 | A1* | 2/2010 | Kuroda | H01Q 1/42 343/755 |
| 2010/0039346 | A1 | 2/2010 | Peter et al. | |
| 2010/0167666 | A1* | 7/2010 | Choudhury | H01Q 21/065 455/90.2 |
| 2011/0057853 | A1* | 3/2011 | Kim | H01Q 1/48 343/843 |
| 2014/0097995 | A1 | 4/2014 | McKinzie, III | |
| 2014/0247194 | A1* | 9/2014 | Durnan | H01Q 9/0407 343/867 |
| 2015/0070228 | A1 | 3/2015 | Gu et al. | |
| 2016/0056544 | A1 | 2/2016 | Garcia et al. | |
| 2016/0156105 | A1 | 6/2016 | Buckley | |
| 2016/0172761 | A1 | 6/2016 | Garcia et al. | |

OTHER PUBLICATIONS

Ramesh Abhari and George Eleftheriades, "Metallo-Dielectric Electromagnetic Bandgap Structures for Suppression and Isolation of the Parallel-Plate Noise in High-Speed Circuits," *IEEE Transactions on Microwave Theory and Techniques*, pp. 1629-1639, Jun. 2003.

* cited by examiner

SUPPRESSION OF SURFACE WAVES IN PRINTED CIRCUIT BOARD-BASED PHASED-ARRAY ANTENNAS

TECHNICAL FIELD

This disclosure relates to suppressing surface waves excited on a printed circuit board for a phased-array antenna.

BACKGROUND

Electronically steerable phased-array antennas may be implemented on multilayer printed circuit boards (PCBs) by stacking multiple planar layers together that include manifold layers and radiating element layers to achieve an antenna far field pattern at a desired frequency. Surface waves may excite on the printed circuit board when radio frequency energy is received at an edge of the printed circuit board. For instance, surface waves may propagate where two layers of media intersect, e.g., between a metal ground plane layer and a dielectric layer. These surface waves cause significant amplitude ripple across the frequency dependent and scan dependent radiating element layers, and thus, severely degrade the overall performance of the phased-array antenna.

Conventional techniques for suppressing surface wave excitation across antenna printed circuit board stacks include placing multiple rows of resistively terminated dummy antenna elements around a perimeter edge of the printed circuit board and placing a magnetic microwave absorber material around the perimeter edge of the dummy elements and attached to a ground plane layer of the antenna printed circuit board stack. While effective for attenuating surface wave propagation across antenna printed circuit board stacks, these conventional techniques require additional materials due to the use of the absorbing material added around the antenna edge, resistors needed for terminating the dummy edge elements, and additional printed circuit board material to accommodate the dummy elements. Accordingly, conventional phased array antenna printed circuit board stacks using additional dummy antenna elements and/or magnetic microwave absorber materials for suppressing surface wave propagation are associated with high manufacturing and material costs unsuitable for use in broadband wireless Internet access with low-cost, high volume consumer electronics.

SUMMARY

One aspect of the disclosure provides a phased-array antenna. The antenna includes an antenna layer of a stacked printed circuit board, a ground plane layer, and a first dielectric layer. The antenna layer of a stacked printed circuit board includes an associated metal patch pattern defined by a series of slots. The stacked printed circuit board defines a thickness extending between a top end of the stacked printed circuit board and a bottom end of the stacked printed circuit board. The ground plane layer of the stacked printed circuit board is spaced apart from the first antenna layer. The first dielectric layer of the stacked printed circuit board is disposed between and in opposed contact with the antenna layer and the ground plane layer. A series of ground vias extend between the top and bottom ends of the stacked printed circuit board. The ground vias are configured to suppress surface waves propagating across the stacked printed circuit board.

Implementations of the disclosure may include one or more of the following optional features. In some implementations, each ground via is formed through the ground plane layer, the first dielectric layer, and a corresponding metal patch of the antenna layer. Each ground via may be formed by drilling a corresponding hole through the entire thickness of the stacked printed circuit board and filling the hole with metal.

The metal filling of the ground vias may be grounded to the ground plane layer. In some examples, the metal filling of at least one of the ground vias may be grounded to the antenna layer. A portion of the metal filling of at least one of the ground vias may be removed proximate to the dielectric layer of the stacked printed circuit board to electrically isolate the metal filling from the dielectric layer.

In some implementations, the antenna includes a radio frequency manifold layer disposed at the bottom end of the stacked printed circuit board and a second dielectric layer of the stacked printed circuit board separating the radio frequency manifold layer and the ground plane layer. The radio frequency manifold layer, the ground plane layer, and the antenna layer may be connected by at least one probe fed via extending between the top and bottom ends of the stacked printed circuit board.

Each ground via may be spaced apart from the at least one probe fed via by at least a predetermined distance to prevent an impedance mismatch. The radio frequency manifold layer may include one of a passive splitter/combiner formed by a conductive micro-strip line formed on the second dielectric layer. A first portion of the ground vias may be formed through metal patches in a vertical feed of the antenna layer. The second portion of the ground vias may be formed through corresponding metal patches in a horizontal feed of the antenna layer. The number of ground vias in the first portion may be equal to the number of ground vias in the second portion.

In some examples, the antenna layer is segmented into four quadrants. Two of the quadrants may each include metal patches having respective ones of the first portion of the ground vias or the second portion of the ground vias formed therethrough. The remaining two quadrants may each include a corresponding metal patch having a respective probe fed via formed therethrough. The series of ground vias may include at least ten ground vias.

Another aspect of the disclosure provides a phased-array antenna assembly. The phased-array antenna assembly includes an antenna board stack defining a thickness between a bottom end and a top end and a radome configured to cover the top end of the antenna board stack. The antenna board includes a central core layer, a bottom multilayer antenna unit, a top multilayer antenna unit and a series of metal-filled ground vias formed through the antenna board stack. The central core layer includes a bottom surface and a top surface disposed on an opposite side of the central core layer than the bottom surface, and defines an axis of symmetry bisecting the bottom surface and the top surface to divide the thickness of the antenna board stack in half. The bottom multilayer antenna unit defines a bottom thickness between the bottom surface of the central core layer and the bottom end of the antenna board stack. The bottom multilayer antenna unit includes two spaced apart bottom metal layers. The top multilayer antenna unit defines a top thickness between the top surface of the central core layer and the top end of the antenna board stack. The top multilayer antenna unit includes two spaced apart metal layers. The metal-filled ground vias extend in a direction substantially perpendicular to the axis of symmetry and are configured to suppress surface waves propagating across the antenna board stack. The radome includes an outer surface and an inner surface disposed on an opposite side of the radome than the outer surface and opposing the top end of the antenna board stack.

This aspect may include one or more of the following optional features. In some implementations, the bottom multilayer antenna unit includes a first bottom metal layer disposed on the bottom surface of the central core layer, a second bottom metal layer and a first bottom dielectric spacer disposed between the first bottom metal layer and the second bottom layer. The unit may also include a second bottom dielectric spacer disposed at the bottom end of the antenna board stack. In some examples, the unit includes a radio frequency manifold layer disposed at the bottom end of the antenna board stack and the second bottom dielectric spacer is disposed between the second metal layer and the radio frequency manifold layer. The top multilayer antenna unit may include a first top metal layer disposed on the top surface of the central core layer and a second top metal layer. The unit may also include a first top dielectric spacer separating the first top metal layer and the second top metal layer and a second top dielectric spacer disposed on an opposite side of the second top metal layer than the first top dielectric spacer. The first and second bottom metal layers, the first and second top metal layers, and the radio frequency manifold layer may be connected by at least one probe fed via extending between the top and bottom ends of the antenna board stack. In some configurations, the radio frequency manifold layer is omitted and the phased-array outputs are instead combined at baseband. In these configurations, the at least one probe fed via extends between the top and bottom ends of the antenna board stack to connect the first and second bottom metal layers and the first and second top metal layers.

In some examples, the first bottom metal layer, the first top metal layer, and the second top metal layer each include a corresponding antenna. The second bottom metal layer may include a ground plane shared by each of the antennas. Each ground via may be formed through a corresponding metal patch of each of the antennas.

A first portion of the ground vias may be formed through corresponding metal patches in vertical fees of the antennas. A second portion of the ground vias may be formed through corresponding metal patches in horizontal feeds of the antennas. The number of ground vias in the first portion may be equal to the number of ground vias in the second portion.

The metal-filled ground vias may be grounded to the second bottom metal layer. One or more of the metal-filled ground vias may be grounded to at least one of the first bottom metal layer, the first top metal layer, or the second top metal layer. A portion of the metal filling of at least one of the ground vias may be removed proximate to the first bottom dielectric spacer to electrically isolate the metal filling from the first bottom dielectric spacer. Each ground via may be spaced apart from the at least one probe fed via by at least a predetermined distance to prevent an impedance mismatch.

In some examples, the radio frequency manifold layer includes a passive splitter/combiner formed by a conductive micro-strip line formed on the second bottom dielectric spacer. The series of metal-filled ground vias formed through the antenna board stack may include at least ten metal-filled ground vias. The radome may be formed from one or more plastic materials. The outer surface of the radome may be coated with a hydrophobic material. The radome and the top end of the antenna board stack may be separated by a top air gap. In some configurations, the radome comprises a C-sandwich radome structure.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

In printed circuit board based phased array antennas, surface waves may propagate on the printed circuit board in response to edge or other radio frequency effects. Surface waves associated with significant amplitude ripple may affect the scan and frequency performance of radiating elements of the phased array, thereby resulting in a degradation in overall antenna performance. Implementations herein are directed toward forming a series of ground vias through the printed circuit board phased array antenna and connecting each ground via to a ground plane and one or more radiating elements to suppress the excitation of surface waves on the printed circuit board. By contrast to the high costs associated with conventional techniques that use dummy elements and/or radio frequency absorbers to suppress surface waves, the ground vias offer a low cost alternative that only requires the drilling of holes through the printed circuit board to form the ground vias. As will become apparent, the number and placement of each ground via is deliberate so that the amplitude of surface waves is greatly reduced without degrading scan performance of the phased array antenna.

Figure 1A:
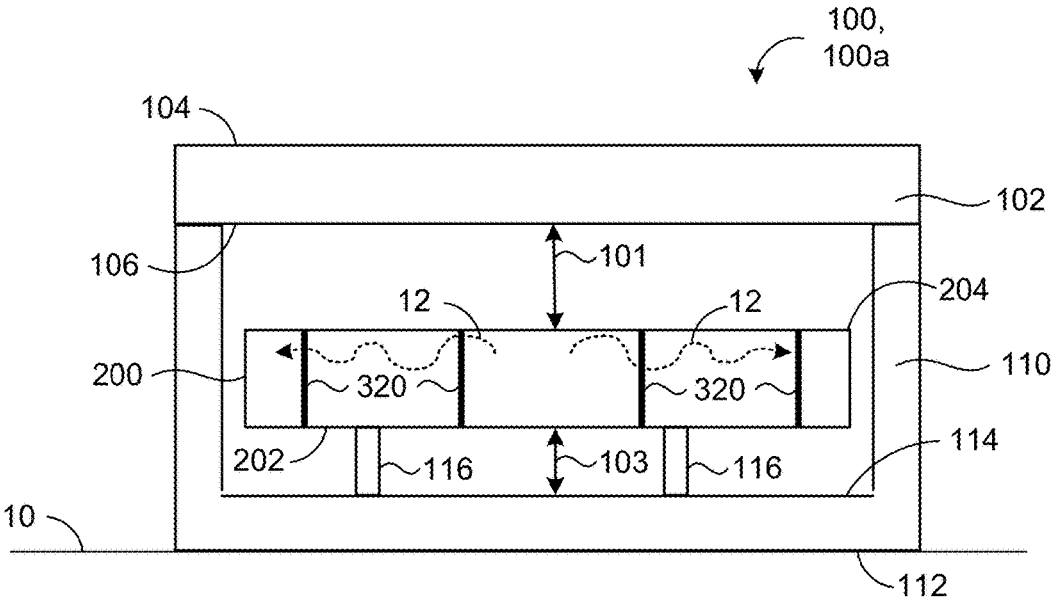
FIG. 1A is a schematic view of an example phased-array antenna assembly including a radome covering an antenna board stack and having a substantially flat outer surface.
Figure 1B:
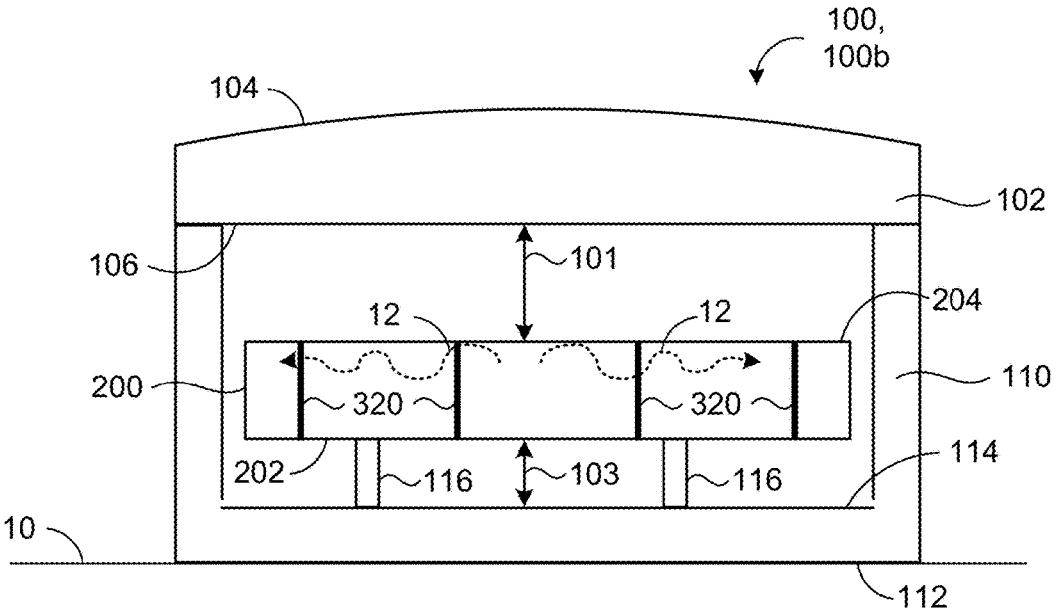
FIG. 1B is a schematic view of an example phased-array antenna assembly including a radome covering an antenna board stack and having a curved outer surface.

Referring to FIGS. 1A and 1B, in some implementations, a phased-array antenna assembly 100, 100*a-b* includes an antenna board stack 200, a radome 102 covering the antenna board stack 200, and a casing 110 supporting the antenna board stack 200 above a ground surface 10. The antenna board stack 200 includes a phased-array antenna implemented on a multilayer printed circuit board (PCB) stack. The antenna board stack 200 may include a top end 204 opposing the radome 102 and a bottom end 202 opposing the casing 110. The antenna board stack 200 may define a thickness extending between the top end 204 and the bottom end 202. In some implementations, the antenna board stack 200 is a steerable active electronically scanned array (AESA) antenna including a single antenna 300 (FIG. 2A) or multiple spaced apart antennas 300, 300*a-c* (FIG. 2B) to achieve desirable antenna directivity at a given frequency.

Edge effects resulting from radio frequency (RF) energy impacting the antenna board stack cause surface waves 12 to propagate across the antenna board stack 200, i.e., across dielectric layer(s) 212 (FIGS. 2A and 2B) of the stack 200. Surface waves 12 associated with high amplitude ripple across the antenna board stack 200 may severely degrade the overall antenna performance. In some implementations, a series of ground vias 320 are formed through the antenna board stack 200 between the top end 204 and the bottom end 202 for suppressing surface waves 12 (e.g., reduce the amplitude ripple) that excite on the antenna board stack 200 to an amplitude suitable for achieving the desirable antenna directivity at the given frequency.

In some examples, the antenna board stack 200 allows for arbitrary dual polarization with wide fractional bandwidth (e.g., greater than 20 percent) and wide scan performance (e.g., +/−45 degrees). In other examples, the antenna board stack 200 allows for only vertical polarization or horizontal polarization. In some examples, a radio frequency (RF) manifold layer 218 (FIGS. 2A and 2B) is disposed at the bottom end 202 of the antenna board stack 200. The antenna board stack 200 may include active phase shifter circuitry using low cost integrated circuits. In some configurations, the antenna board stack 200 uses multi-chip modules with a passive network to combine outputs of each chip module in a receive mode or split a common input to drive each chip module in a transmit mode (i.e., the RF manifold 218). The antenna board stack 200, or a separate daughter board (not shown) in communication with the antenna board stack 200, may include power management features, phase and gain control for each antenna 300, RF up and down conversion, a modem, and/or other digital communications hardware. Here, phased-array outputs may be combined at baseband.

The casing 110 includes an interior surface 114 opposing the bottom end 202 of the antenna board stack 200 and a ground-engaging surface 112 disposed on an opposite side of the casing 110 than the interior surface 114. The casing 110 protects exposed surfaces of the antenna board stack 200 not covered by the radome 102 from weather elements such as rain, snow, and/or debris-build up. A low cost lossy dielectric material may be attached to the casing 110 to suppress microstrip cavity resonances. In some implementations, the casing 110 includes one or more support members 116 (e.g., feet) extending from the interior surface 114 and into contact with the bottom end 202 of the antenna board stack 200 to support the antenna board stack 200 above the ground 10 and define a bottom air gap 103 therebetween. The bottom air gap 103, in conjunction with a lossy material and metal enclosure, may suppress resonance between the bottom end 202 of the antenna board stack 200 and the overall casing 110. For example, the bottom air gap 103 may suppress resonance between the RF manifold layer 218 disposed at the bottom end 202 of the antenna board stack 200 and the casing 110 that would otherwise negatively impact RF performance of the antenna board stack 200. More specifically, the lossy dielectric layer suppressing microstrip cavity resonances allows a low cost microstrip manifold to be used, instead of a high cost stripline manifold. High cost stripline manifolds generally require multi-lamination, unbalanced printed circuit boards.

The antenna board stack 200 may be used outdoors and the radome 102 may protect the antenna board stack 200 from the weather elements such as rain, snow, and/or debris-build up. The radome 102 includes an outer surface 104 and an inner surface 106 disposed on an opposite side of the radome 102 than the outer surface 104 and opposing the top end 204 of the antenna board stack 200. In some implementations, the radome 102 is co-designed with the antenna board stack 200 to achieve desirable antenna directivity at a desired fractional bandwidth. Accordingly, the radome 102 may be integrated with the antenna board stack 200 and formed from one or more low-cost plastics such as polystyrene without the need to use expensive multilayer radomes such as a C-sandwich radome structure. However, in other implementations, the radome 102 includes a C-sandwich radome structure or other type of radome structure integrated with the antenna board stack 200. The antenna board stack 200 may be a balanced antenna board stack 200 where the radome 102 is configured to protect radiating elements of the balanced printed board stack 200. The combination of the radome 102 and radiating element(s) of the antenna board stack 200 results in the phased-array antenna assembly 100 having a relatively wide scan volume and frequency bandwidth.

In some implementations, a top air gap 101 is defined between the inner surface 106 of the radome 102 and the top end 204 of the antenna board stack 200 to allow for impedance control of the antenna across all scan angles. Referring to FIGS. 1A and 1B, in some examples, the casing 110 supports the radome 102 over the top end 204 of the antenna board stack 200 with the top air gap 101 separating the top end 204 and the inner surface 106. In other examples, support members may extend from the radome 102 to support the radome 102 upon the top end 204 of the antenna board stack 200 and define the top air gap 101 separating the top end 204 and the inner surface 106.

Referring to FIG. 1A, in some implementations, the outer surface 104 of the radome 102 is substantially flat and coplanar with the ground surface 10. The flat outer surface 104, however, may permit water and/or snow to build up, and thereby adversely impact the RF performance of the antenna board stack 200. To prevent water and/or snow from building up, the outer surface 104 may be coated with a hydrophobic coating when the radome 102 is formed from plastics (e.g., polystyrene). Referring to FIG. 1B, in other implementations, the outer surface 104 of the radome 102 is curved to facilitate water and/or snow run-off. Additionally or alternatively, the radome 102 and the top end 204 of the antenna board stack 200 may be sloped relative to the interior surface 114 and the ground-engaging surface 112 of the casing 110 to facilitate water and/or snow run-off from the outer surface 104 of the radome 102 and/or the top end 204 of the antenna board stack 200.

Figure 2A:
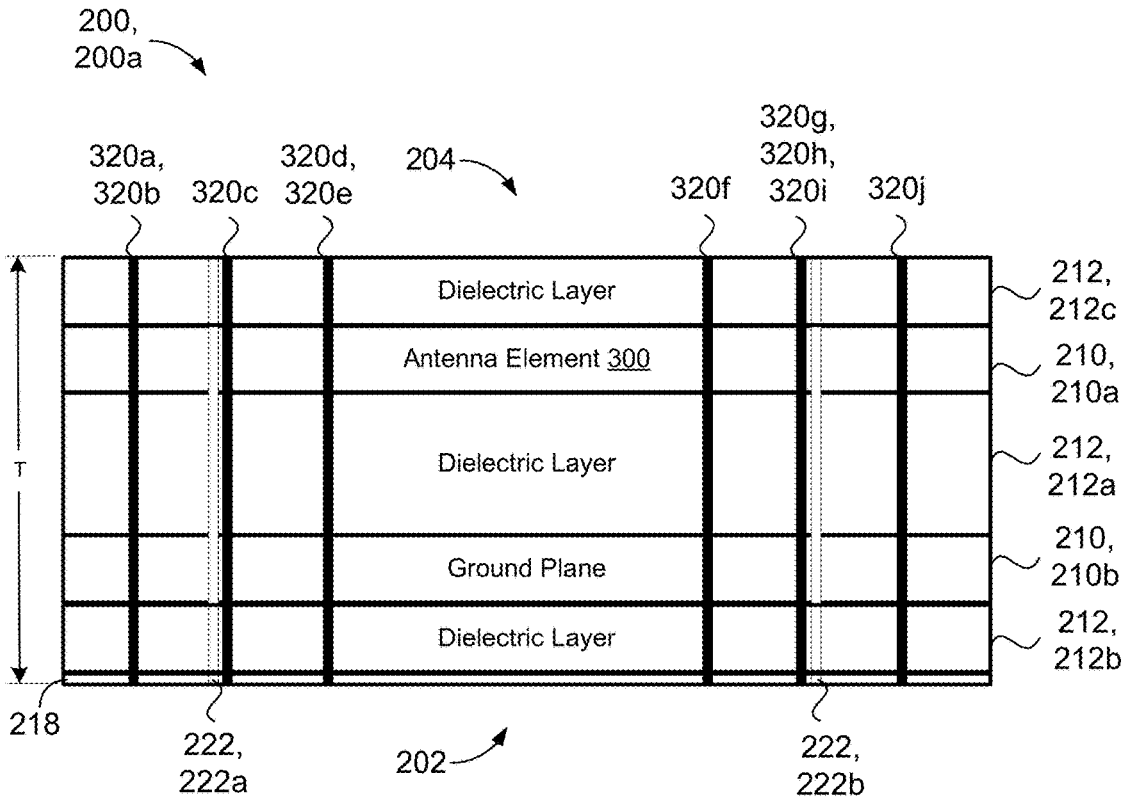
FIG. 2A is a schematic view of an example antenna board stack implementing an antenna element.

Referring to FIG. 2A, in some implementations, an antenna board stack 200, 200*a* includes two spaced-apart metal layers 210, 210*a-b* and at least one dielectric layer 212, 212*a-c* in opposed contact with each of the metal layers 210*a-b*. The antenna board stack 200*a* defines a thickness T between the bottom end 202 and the top end 204. The metal layers 210 may be formed from conductive metals such as copper. The dielectric layers 212 may be formed from printed circuit board materials such as flame retardant 4 (FR4) glass epoxy composites and include dielectric constants ranging from about 3.0 to about 5 for desirable antenna performance at frequencies below about 15 GHz. The dielectric layers 212 may be formed from at least one substrate core layer and/or at least one pre-impregnated composite fiber layer.

In some examples, the antenna board stack 200*a* includes a first metal layer 210*a*, a second metal layer 210*b* spaced apart from the first metal layer 210*a*, and a central dielectric layer 212*a* disposed between and separating the first metal layer 210*a* and the second metal layer 210*b*. The thicknesses of the first metal layer 210*a* and the second metal layer 210*b* may be substantially the same such that the metal layers 210*a*, 210*b* are equally balanced about the central dielectric layer 212*a* to prevent warping of the antenna board stack 200*a*. A bottom dielectric layer 212*b* is disposed between the second metal layer 210*b* and the RF manifold 218 disposed at the bottom end 202 of the antenna board stack 200*a*. Thus, the antenna board stack 200*a* may include all active and passive components disposed proximate to the bottom end 202 of the antenna board stack 200, while the top end 204 faces the direction of antenna radiation. In some examples, microstrip transmission lines are formed on the bottom dielectric layer 212*b* to provide the RF manifold layer 218 associated with a relatively sparse layer of metal. In other examples, the RF manifold layer 218 is formed by removing portions of a corresponding metal layer, e.g., by etching.

In some implementations, the first metal layer 210*a* includes a corresponding antenna 300 and the second metal layer 210*b* includes a ground plane 210*b* shared by the antenna 300 and the RF manifold layer 218 disposed at the bottom end 202 of the antenna board stack 200*a*. In some examples, at least one probe fed via 222, 222*a-b* extends between the bottom end 202 and the top end 204 of the antenna board stack 200*a*, and connects the antenna 300, the RF manifold layer 218, and the ground plane 210*b* together for distributing RF signals. The probe fed vias 222 may be formed by drilling a hole through the antenna board stack 200*a* and filling the hole with metal. Epoxy resins may also optionally fill the probe fed vias 222. Via stubs at the top end 204 of the antenna board stack 200*a* may be back-drilled or left in place based upon the antenna RF requirements.

Figure 2B:
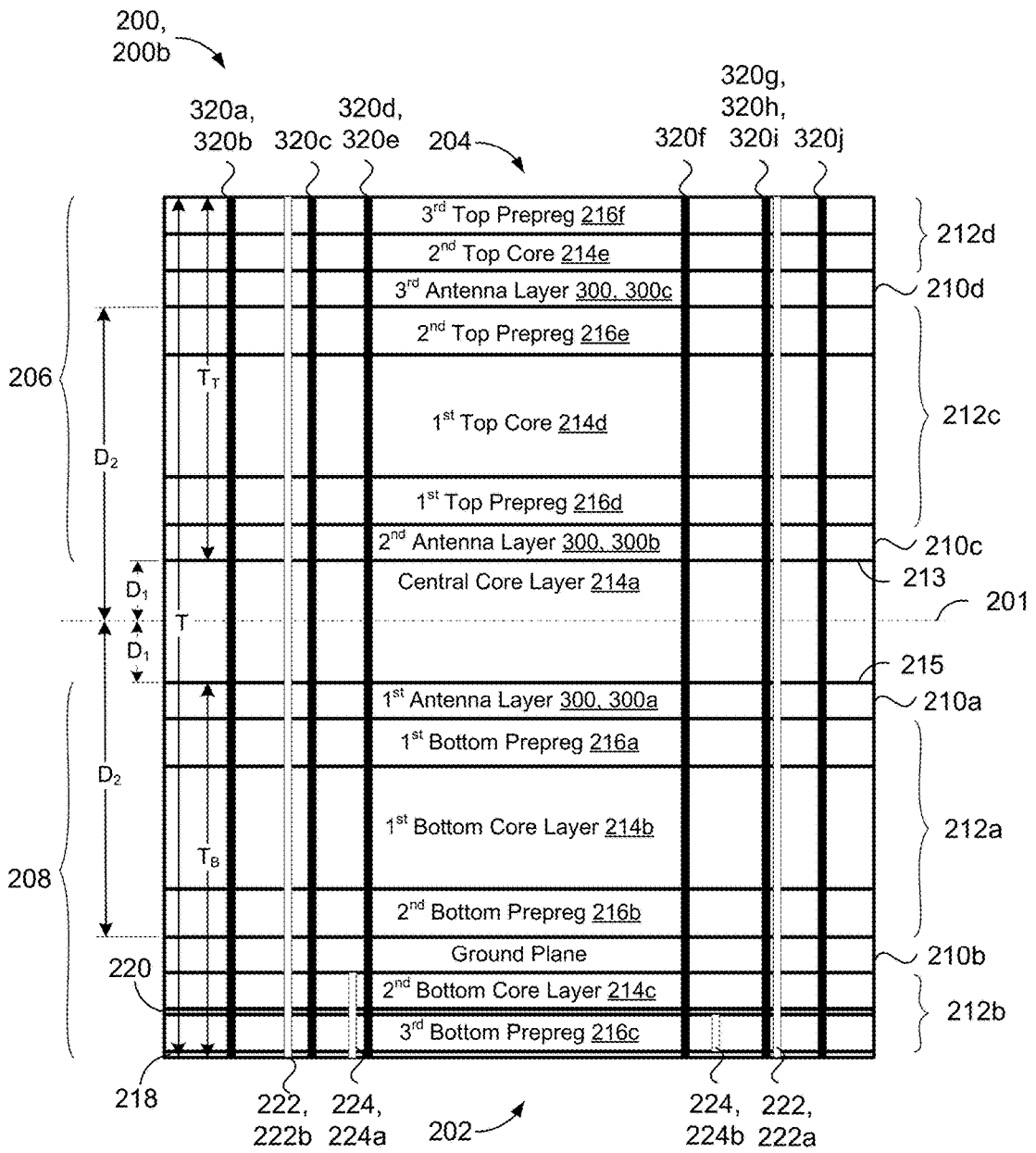
FIG. 2B is a schematic view of an example antenna board stack implementing a phased-array antenna.

Referring to FIG. 2B, in some implementations, the antenna board stack 200*b* includes a bottom multilayer antenna unit 208 (hereinafter 'bottom portion 208'), a top multilayer antenna unit 206 (hereinafter 'top portion 206'), and a central core layer 214*a* disposed between the bottom portion 208 and the top portion 206. The antenna board stack 200*b* defines a thickness T between the bottom end 202 and the top end 204. In some implementations, a soldermask layer is applied to the bottom end 202 and the top end 204 of the antenna board stack 200. The soldermask layer at each of the bottom end 202 and the top end 204 may be 0.5 mils (e.g., 0.0005 inches). The central core layer 214*a* may include a bottom surface 215 and a top surface 213 disposed on an opposite side of the central core layer 214*a* than the bottom surface 215. An axis of symmetry 201 may bisect the bottom surface 215 and the top surface 213 of the central core layer 214*a* to divide the thickness T of the antenna board stack 200*b* in half. The bottom portion 208 of the antenna board stack 200 may define a bottom thickness $T_B$ between the bottom surface 215 of the central core layer 214*a* and the bottom end 202 of the antenna board stack 200. The top portion 206 of the antenna board stack 200 may define a top thickness $T_T$ between the top surface 213 of the central core layer 214*a* and the top end 204 of the antenna board stack 200*b*. The bottom thickness $T_B$ and the top thickness $T_T$ may be substantially equal and balanced about the central core layer 214*a*, and also balanced about the axis of symmetry 201.

The antenna board stack 200*b* includes four spaced-apart metal layers 210*a-d* and at least one of the central core layer 214*a* or dielectric spacer layers 212*a-d* in opposed contact with each of the metal layers 210*a-d*. The metal layers 210*a-d* may be formed from conductive metals such as copper. The dielectric spacer layers 212*a-d* and the central core layer 214*a* may be formed from printed circuit board materials such as flame retardant 4 (FR4) glass epoxy composites and include dielectric constants ranging from about 3.0 to about 5 for desirable antenna performance at frequencies below about 15 GHz. Each dielectric spacer layer 212*a-d* may include one substrate core layer 214*b-e* and at least one composite fiber layer 216*a-f*, e.g., at least one pre-impregnated composite fiber layer, (hereinafter 'prepreg layer 216*a-f*'). As used herein, the terms 'dielectric spacer layer', 'dielectric layer', and 'dielectric spacer' may be used interchangeably. Moreover, the at least one composite fiber layer 216*a-f* may be any insulating layer (e.g., a layer having electrical insulating properties).

The metal layers 210*a-d* and the dielectric layers 212*a-d* may be equally balanced about the central core layer 214*a* to prevent warping of the antenna board stack 200*b*. As used herein, equally balancing the metal layers 210*a-d* and the dielectric spacer layers 212*a-d* about the central core layer 214*a* refers to the top portion 206 and the bottom portion 208 of the antenna board stack 200 including an equal number of metal layers 210*a-d* and dielectric spacer layers 212*a-d* with corresponding ones of the metal layers 210*a-d* and dielectric spacer layers 212*a-d* displaced by substantially the same distance from the corresponding one of the top surface 213 or the bottom surface 215 of the central core layer 214*a*. The balanced antenna board stack 200*b* allows the number of total layers required to achieve desirable antenna directivity at a given frequency to be minimized. Additionally, and as will become more apparent, the balanced antenna board stack 200 eliminates the need for multiple lamination cycles in manufacturing. Thus, balancing the antenna board stack 200*b* prevents warping and reduces manufacturing costs by reducing the total number of layers and eliminating the need for multiple lamination cycles to manufacture the antenna board stack 200*b*.

The bottom portion 208 of the antenna board stack 200 may include a first bottom metal layer 210*a* in opposed contact with the bottom surface 215 of the central core layer 214*a* and having a first distance $D_1$ from the axis of symmetry 201, and a second bottom metal layer 210*b* spaced apart from the first bottom metal layer 210*a* and having a second distance $D_2$ from the axis of symmetry 201. Similarly, the top portion 206 of the antenna board stack 200 may include a first top metal layer 210*c* in opposed contact with the top surface 213 of the central core layer 214*a* and having the first distance $D_1$ from the axis of symmetry 201, and a second top metal layer 210*d* spaced apart from the first top metal layer 210*c* and having the second distance $D_2$ from the axis of symmetry 201. The thicknesses of the first bottom metal layer 210*a* and the first top metal layer 210*c* may be substantially the same, and the thicknesses of the second bottom metal layer 210*b* and the second top metal layer 210*d* may be substantially the same.

The top portion 206 of the antenna board stack 200*b* may include two dielectric spacers including a first top dielectric layer 212*c* and a second top dielectric layer 212*d*. The first top dielectric layer 212*c* may be disposed between the first top metal layer 210*c* and the second top metal layer 210*d*. The second top dielectric layer 212*d* may be disposed on an opposite side of second top metal layer 210*d* than the first top dielectric layer 212*c*.

The bottom portion 208 of the antenna board stack 200 may also include two dielectric spacers including a first bottom dielectric layer 212*a* and a second bottom dielectric layer 212*b*. The first bottom dielectric layer 212*a* may be disposed between the first bottom metal layer 210*a* and the second bottom metal layer 210*b*. The first bottom dielectric layer 212*a* may include a thickness substantially equal to a thickness of the first top dielectric layer 212*c* of the top portion 206. The second bottom dielectric layer 212*b* may be disposed between the second bottom metal layer 210*b* and the RF manifold layer 218 disposed at the bottom end 202 of the antenna board stack 200. The second bottom dielectric layer 212*b* may include a thickness substantially equal to a thickness of the second top dielectric layer 212*d* of the top portion 206.

In some implementations, the first bottom dielectric layer 212*a* of the bottom portion 208 includes a first bottom prepreg layer 216*a* disposed an opposite side of the first bottom metal layer 210*a* than the central core layer 214*a*, a second bottom prepreg layer 216*b* disposed on the second bottom metal layer 210*b*, and a first bottom core layer 214*b* disposed between the first bottom prepreg layer 216*a* and the second bottom prepreg layer 216*b*. The second bottom dielectric layer 212*b* of the bottom portion 208 may include a second bottom core layer 214*c* disposed on an opposite side of the second bottom metal layer 210*b* than the second bottom prepreg layer 216, and a third bottom prepreg layer disposed between the second bottom core layer 214*c* and the RF manifold layer 218.

In some examples, the first top dielectric layer 212*c* of the top portion 206 includes a first top prepreg layer 216*d* disposed on an opposite side of first top metal layer 210*c* than the central core layer 214*a*, a second top prepreg layer 216*e* disposed on the second top metal layer 210*d*, and a first top core layer 214*d* disposed between the first top prepreg layer 216*d* and the second top prepreg layer 216*e*. The second top dielectric layer 216*d* of the top portion 206 may include a second top core layer 214*e* disposed on an opposite side of the second top metal layer 210*d* than the second top prepreg layer 216*e*, and a third top prepreg layer 216*f* disposed at the top end 204 of the antenna board stack 200*b* on an opposite side of the second top core layer 214*e* than the second top metal layer 210*d*.

The antenna board stack 200*b* may include all active and passive components disposed proximate to the bottom end 202 of the antenna board stack 200*b*, while the top end 204 faces the direction of antenna radiation. In some implementations, the RF manifold layer 218 is disposed at the bottom end 202 and includes a passive splitter/combiner implemented from microstrip transmission lines formed on the second bottom dielectric layer 212*b*. The RF manifold layer 218 may be built as a reactive network or with Wilkinson splitter/combiners using conventional surface mount resistors. Control and routing for the antenna board stack 200 may also be implemented with the RF manifold layer 218 at the bottom end 202 or a control routing conductive layer 220 disposed between the second bottom core layer 214*c* and the third bottom prepreg layer 216*c* may provide the control and routing. The control routing conductive layer 220 may include a microstrip line formed on the second bottom core layer 214*c* or the third bottom prepreg layer 216*c*. For example, the microstrip line associated with the control routing conductive layer 220 may be printed on the second bottom core layer 214*c* or the third bottom prepreg layer 216*c*. The RF manifold layer 218 and control routing conductive layer 220 are associated with relatively sparse layers of metal. Accordingly, a metal layer corresponding to the control routing conductive layer 220 may be disposed between the second top core layer 214*e* and the third top prepreg layer 216*f* of the top portion 206 and another metal layer corresponding to the RF manifold layer 218 may be disposed at the top end 204 to balance metal density about the central core layer 214*a*. However, FIG. 2B shows these corresponding metal layers removed, e.g., by etching.

In some examples, the antenna board stack 200*b* includes a balanced printed circuit board stack having three radiating element layers 300, 300*a-c*, the ground plane 210*b*, and the microstrip manifold layer 218. In some implementations, the first bottom metal layer 210*a*, the first top metal layer 210*c*, and the second top metal layer 210*d* each include a corresponding antenna 300, 300*a-c*, and the second bottom metal layer 210*b* includes the ground plane 210*b* shared by each of the antennas 300 and the RF manifold layer 218 disposed at the bottom end 202 of the antenna board stack 200. Accordingly, the antenna board stack 200*b* does not require the use of multiple ground planes connected through multiple internal vias, thereby allowing the antenna board stack to be manufactured using a single lamination cycle, and thus reducing the cost of manufacturing. In some examples, as with the antenna board stack 200*a* of FIG. 2A, the antenna board stack 200*b* includes the at least one probe fed via 222, 222*a-b* extending between the bottom end 202 and the top end 204 of the antenna board stack 200*b*, and connecting each antenna 300*a-c*, the RF manifold layer 218, and the ground plane 210*b* together for distributing RF signals. The probe fed vias 222 may be formed by drilling a hole through antenna board stack and filling the hole with metal. Epoxy resins may also optionally fill the probe fed vias 222. Via stubs at the top end 204 of the antenna board structure may be back-drilled or left in place based upon the antenna RF requirements.

In some examples, the RF manifold layer 218 connects to the control routing conductive layer 220 and the ground plane layer 210*b* using controlled-depth vias 224, 224*a-b*. For example, a first controlled-depth via 224*a* may be formed through the second bottom dielectric layer 212*b* between the radio frequency manifold layer 218 and the ground plane layer 210*b* to connect the radio frequency manifold layer 218 to the ground plane 210*b*. Specifically, the first controlled-depth via 224*a* may be formed through the third bottom prepreg layer 216*c*, the control routing conductive layer 220, and the second bottom core layer 214*c*. A second controlled-depth via 224*b* may also be formed through the third bottom prepreg layer 216*c* between the radio frequency manifold layer 218 and the control routing conductive layer 220 to connect the radio frequency manifold layer 218 to the control routing conductive layer 220. The third bottom prepreg layer 216*c* and the second bottom core layer 214*c* having small dielectric thicknesses allows the first controlled-depth vias 224*a* to include a diameter of about 1.25 times the combined dielectric thickness of the third bottom prepreg layer 216*c* and the second bottom core layer 214*c*. The second controlled-depth via 224*b* may include a diameter of about 1.25 times the dielectric thickness of the third bottom prepreg layer 216*c*. The controlled-depth vias 224 may be drilled with a laser and optionally filled with metal to provide a standard high density interconnect approach.

The antennas 300 associated with the first bottom metal layer 210*a* (e.g., first antenna layer 300*a*), the first top metal layer 210*c* (e.g., second antenna layer 300*b*), and the second top metal layer 210*d* (e.g., third antenna layer 300*c*) provide the phased-array antenna that may be tuned with the radome 102 to provide wide scan performance (e.g., +/−45 degrees) and wide fractional bandwidth (e.g., greater than 20 percent) with arbitrary dual polarization. In some implementations, the antenna layers 300 include slotted antenna apertures. The first antenna layer 300*a* includes a corresponding first metal pattern that may be formed on the bottom surface 215 of the central core layer 214*a* or the first bottom dielectric layer 212*a*. The second antenna layer 300*b* includes a corresponding second metal pattern that may be formed on the top surface 213 of the central core layer 214*a* or the first top dielectric layer 212*c*. The third antenna layer 300*c* includes a corresponding third metal pattern that may be formed on the second top core layer 214*e* or on an opposite side of the first top dielectric layer 212*c* than the second antenna layer 300*b*. At least one of the antenna layers 300 may be associated with a different metal pattern. The metal patterns associated with each of the antennas 300 may cooperate to provide higher-order floquet-mode scattering for the phased-array antenna implemented on the antenna board stack 200. The metal patterns may be defined by slots 302 (FIG. 3) formed through the metal layers 210*a*, 210*c*, 210*d* via etching and/or cutting to define the metal patterns. The metal layers 210*a*, 210*c*, 210*d* associated with the antennas 300 may include substantially square and planar metal plates. For instance, the metal plates may be formed from conductive metals such as copper. In some examples, each metal layer 210*a*, 210*c*, 210*d* includes a square plate including a length of up to one half wavelength on each side.

With continued reference to FIGS. 2A and 2B, the antenna board stack 200, 200*a-b* also includes a series of ground vias 320, 320*a-j* formed therethrough for suppressing surface waves 12 (e.g., reducing amplitude ripple) that excite across the antenna board stack 200, 200*a-b* to an amplitude suitable for achieving desirable antenna directivity. Due to edge effects from RF energy, the surface waves 12 may propagate across the dielectric materials of one or more of the layers 212, 214 above the ground plane 210*b*. Specifically, the ground vias 320 are formed by drilling holes all of the way through the antenna board stack 200 from the top end 204 to the bottom end 202 and then filling each of the ground via 320 holes with metal. In some examples, one or more of the ground vias 320 are entirely filled with metal along the thickness of the stack 200. Additionally or alternatively, at least one of the ground vias 320 is filled with metal along a portion of the thickness of the stack 200. Epoxy resins may also optionally fill the ground vias 320. The ground vias 320 include an arrangement that effectively dampens amplitude ripple of surface waves 12 propagating across the dielectric layers 212 and/or central core layer 214 by breaking up resonance while maintaining acceptable antenna performance parameters associated with return loss, scan performance, bandwidth, and/or cross-polarization. Thus, some residual ripple of the surface waves 12 may still propagate, but the amplitude thereof, is acceptable for maintaining acceptable antenna performance.

In some examples, the greater the number of ground vias 320 equates to greater dampening of the surface waves 12. However, the ground vias 320 should not interfere with physical components implemented by the antenna board stack 200. Accordingly, the geographic arrangement of physical components implemented by the board stack 200 dictate the number and arrangement (pattern) of ground vias 320 formed therethrough. For instance, antenna board stack physical components may include, without limitation, multi-chip modules, power management features, phase and gain control for radiating elements, RF up and down conversion, a modem, and/or other digital communications hardware.

Moreover, each ground via 320 may be spaced apart from the probe fed vias 222 (and control-depth vias 224 when present) to avoid an impedance mismatches when powering the antenna board stack 200. In some implementations, the metal filling of one or more of the ground vias 320 attaches to the ground plane 210*b* via metal grounding, e.g., direct current (DC) grounding. Additionally, the metal filling of one or more of the ground vias 320 may attach to one or more of the antenna elements 300 via metal grounding (e.g., DC grounding) to break up resonance across the stack 200 by allowing energy to travel across the antenna elements 300. In some examples, a portion of the metal filling of at least one of the ground vias 320 is removed proximate to at least one of the dielectric layers 212 and/or central core layer 214 to electrically isolate the at least one ground via 320 from the at least one dielectric layer 212 and/or central core layer 214. Accordingly, one or more portions the ground via 320 extending along the thickness of the antenna board stack 200 may include metal filling that attaches to one or more metal layers 210 via DC grounding while the metal filling may be removed proximate to the dielectric materials of the dielectric layers 212 and/or central core layer 214.

Figure 3:
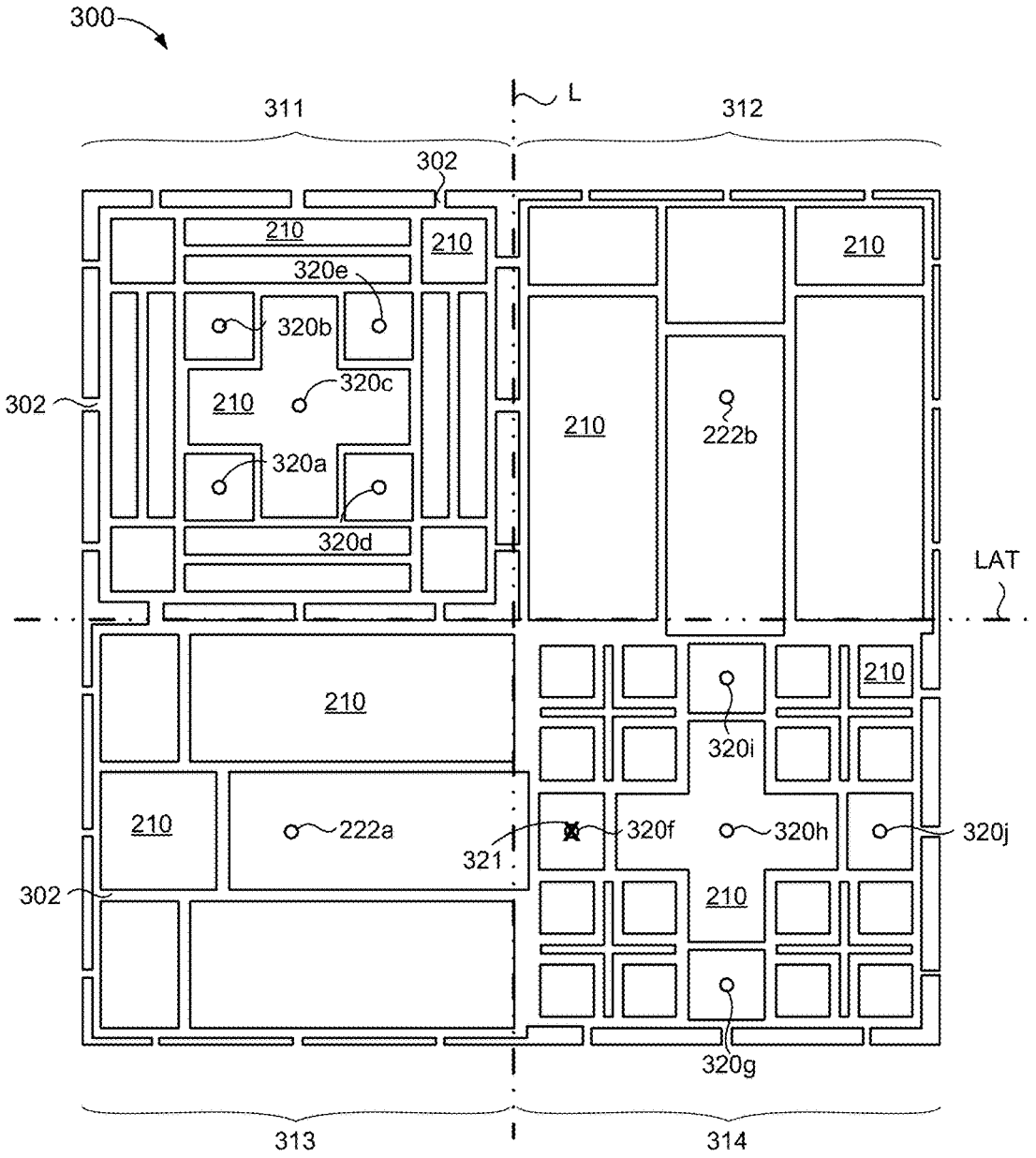
FIG. 3 is a schematic view of the antenna element of the antenna board stack of FIG. 2A having a series of ground vias formed through metal patches of the antenna element.

FIG. 3 shows an exemplary antenna element 300 having a corresponding metal pattern defined by a series of slots 302 formed through a metal layer 210 and a series of ground vias 320, 320*a-j* formed through the metal layer 210. Thus, the metal pattern is associated with a plurality of metal patches of the metal layer 210 separated by the series of slots 302 (i.e., slotted antenna aperture) formed therethrough and each ground via 320 is formed through a corresponding one of the metal patches of the metal layer 210. The antenna element 300 includes a circularly polarized antenna element having dual feeds (i.e., vertical and horizontal feeds) and may correspond to any of the element elements 300 of FIGS. 2A and 2B. In some examples, the antenna element 300 operates in the five (5.0) gigahertz (GHz) band. The series of slots 302 may extend both vertically and horizontally to define the metal pattern for the antenna element 300 to enable dual polarization. In the example, the metal layer 210 associated with the antenna element 300 is a substantially square and substantially planar metal plate defining a longitudinal axis L and lateral axis LAT to divide the antenna element 300 into four quadrants 311, 312, 313, 314. Here, quadrants 311 and 312 are associated with a vertical feed of the antenna element 300 while quadrants 313 and 314 are associated with a horizontal feed of the element. The probe feed vias 222, 222*a-b* are formed through associated ones of orthogonal metal patches of the metal layer 210. For instance, a first probe feed via 222*a* is formed through a horizontally extending metal patch of the metal layer 210 in the horizontal feed quadrant 313 and a second probe feed via 222*b* is formed through a vertically extending metal patch of the metal layer 210 in the vertical feed quadrant 312. In other implementations, antenna elements having metal patterns enabling horizontal or vertical polarization are also possible which only include a single probe feed via 222 (i.e., vertical feed or horizontal feed) extending therethrough.

In some implementations, a first portion of the ground vias 320*a-e* are formed through the metal layer 210 in the vertical feed quadrant 311 and a second portion of the ground vias 320*f-j* are formed through the metal layer 210 in the horizontal feed quadrant 314. In some examples, each ground via 320 is spaced apart from the nearest probe feed via 222 by at least a predetermined distance to prevent an impedance mismatch. Accordingly, the antenna element 300 includes a metal patch pattern and an arrangement of ground vias 320 that maintains acceptable antenna performance parameters for a phased-array antenna implemented on a PCB stack 200 while effectively suppressing surface wave propagation across the PCB stack 200. For instance, the antenna element 300 may cooperate with one or more other antenna elements having the same or different metal patterns to provide a phased-array antenna that may be tuned with the radome 102 to provide wide scan performance (e.g., +/−45 degrees) and wide fractional bandwidth (e.g., greater than 20 percent) with arbitrary dual polarization and acceptable levels of return loss. In some examples, the metal filling of one or more of the ground vias 320 attaches to the corresponding metal patches of the metal layer 210 via metal grounding (e.g., DC grounding) 321. The example shows the metal grounding 321 attaching the metal layer 210 and the metal filling of the corresponding ground via 320*f* formed therethrough in the horizontal feed quadrant 314. The metal grounding 321 may allow a portion of RF energy travelling along the ground via 320*f* to travel across the antenna element 300 and, thus, break up resonance and dampen surface wave amplitude. The metal grounding 321 may also attach the metal layer 210 to the metal filling of one or more of the other ground vias 320.

Figure 4:
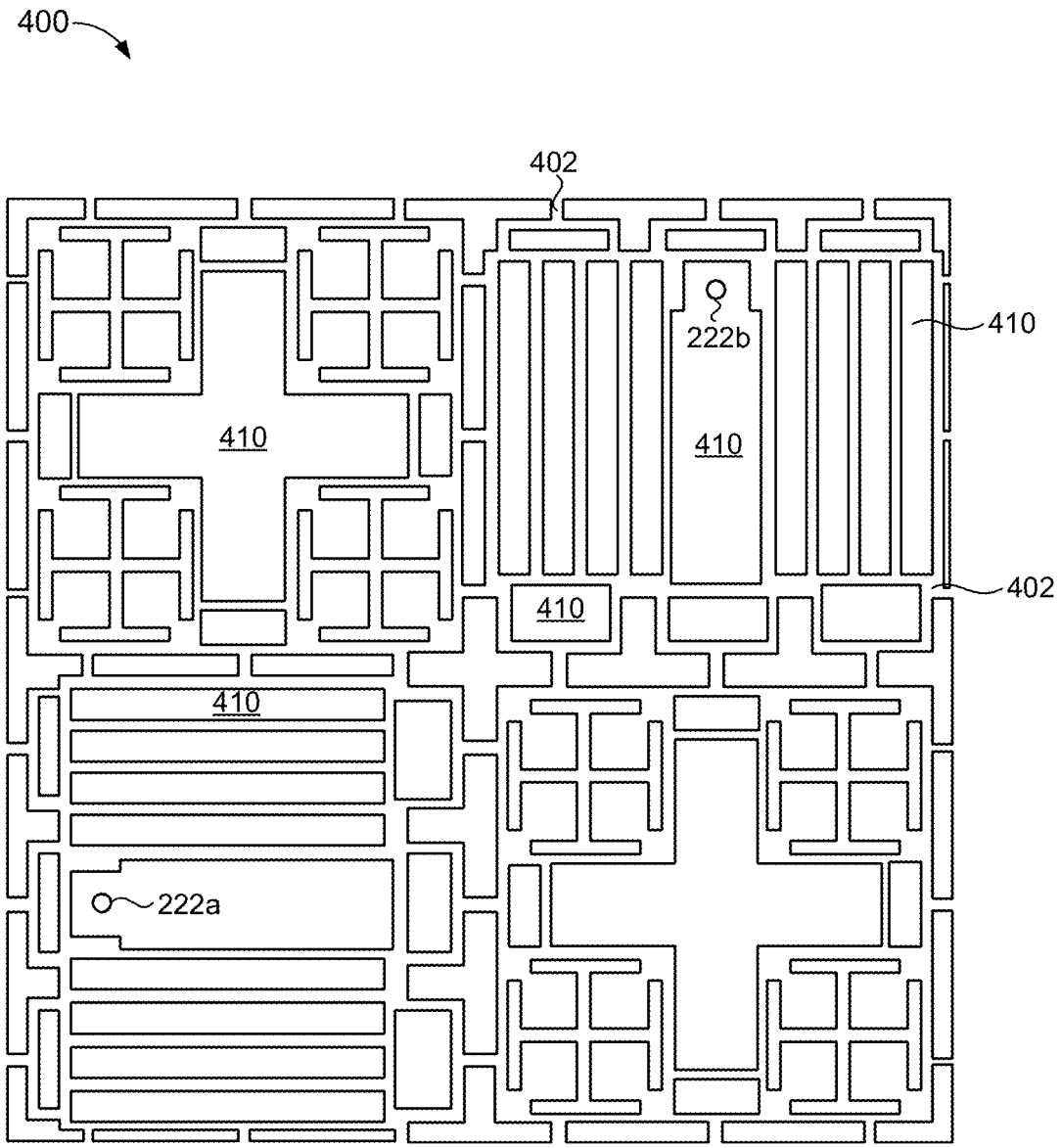
FIG. 4 is a schematic view of an example antenna element without having any ground vias formed through metal patches of the antenna element.

FIG. 4 shows an exemplary antenna element 400 having a corresponding metal pattern defined by a series of slots 402 formed through a metal layer 210 without drilling any ground vias 320 through the metal layer 410 for suppressing surface waves. In some examples, the antenna element 400 operates in the five (5.0) gigahertz (GHz) band. The metal pattern associated with the antenna element 400 may provide the same antenna performance as the metal pattern associated with the antenna element 300 of FIG. 3. Accordingly, the antenna element 300 of FIG. 3 changes the antenna pattern to accommodate the series of ground vias 320 while maintaining the same antenna performance as the antenna element 400 without the use of ground vias. FIG. 4 shows the series of slots 402 extending both vertically and horizontally to define a metal pattern for the antenna 400 to enable dual polarization. The probe feed vias 222 may be formed through associated ones of orthogonal metal patches of the metal layer 410.

Figure 5:
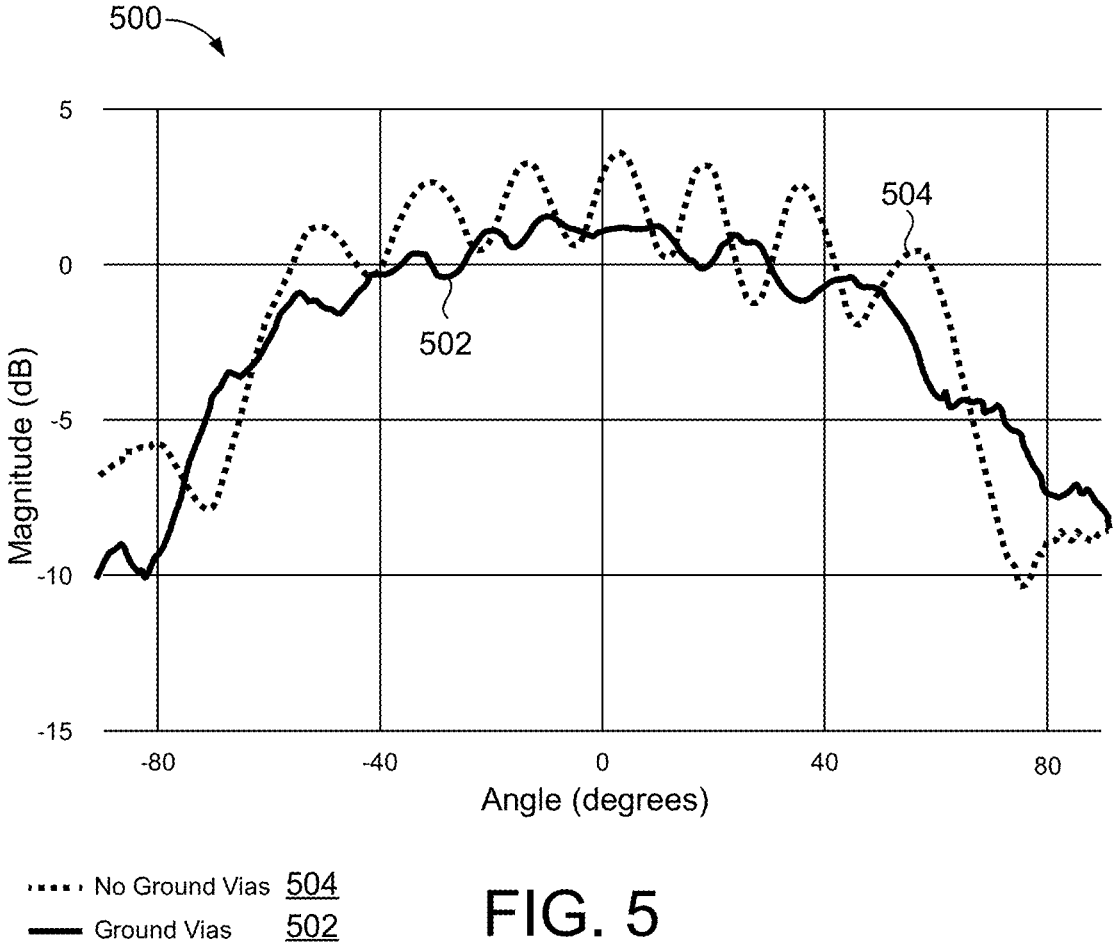
FIG. 5 is a plot comparing surface wave ripple as a function of scan angle for each of the antenna elements of FIG. 3 and FIG. 4.

FIG. 5 shows a plot 500 comparing surface wave excitation in the E plane as a function of scan angle for both the antenna element 300 of FIG. 3 and the antenna element 400 of FIG. 4. The vertical y-axis denotes the amplitude/magnitude of surface wave ripple in decibels (dB) and the horizontal x-axis denotes scan angle ranging from −90° to 90°. The solid line 502 corresponds to the magnitude of surface wave ripple for the antenna element 300 having the series of ground vias 320*a-j* formed through the corresponding metal patches 210 in both the horizontal and vertical feeds. The dotted line 504 corresponds to the magnitude of surface wave ripple for the antenna element 400 without having any ground vias 320 formed therethrough. The plot 500 illustrates that the ground vias 320 formed through the antenna element 300 are effective for reducing the magnitude of surface wave ripple (solid line 502) compared to the magnitude of surface wave ripple (dotted line 504) propagating across the antenna element 400 without the ground vias.

Figure 6B:
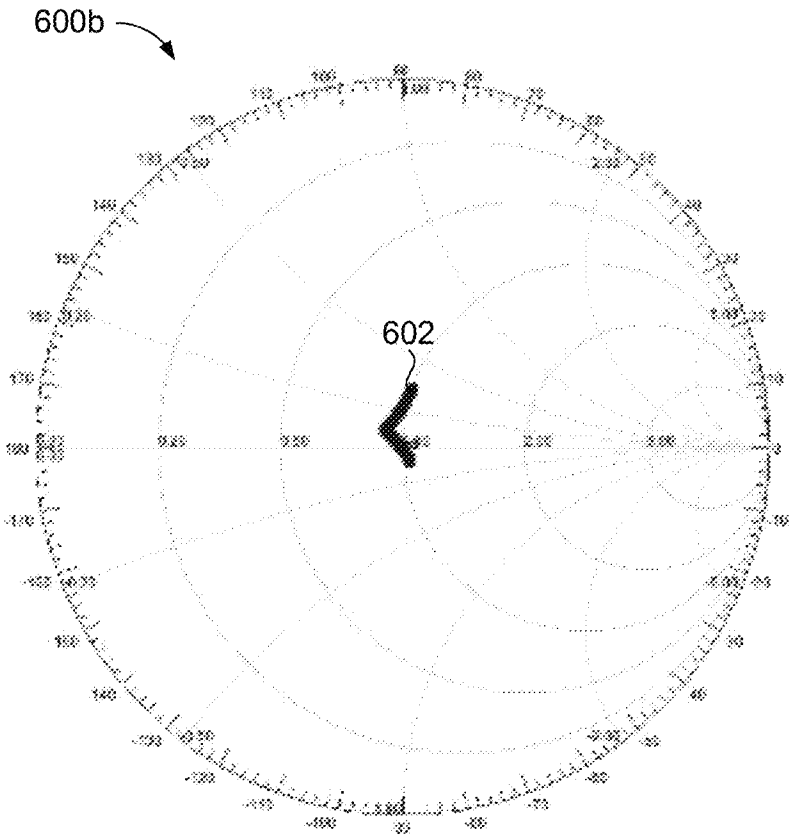
FIG. 6B is an example Smith chart simulating return loss at boresight for the antenna element of FIG. 3.
Figure 6A:
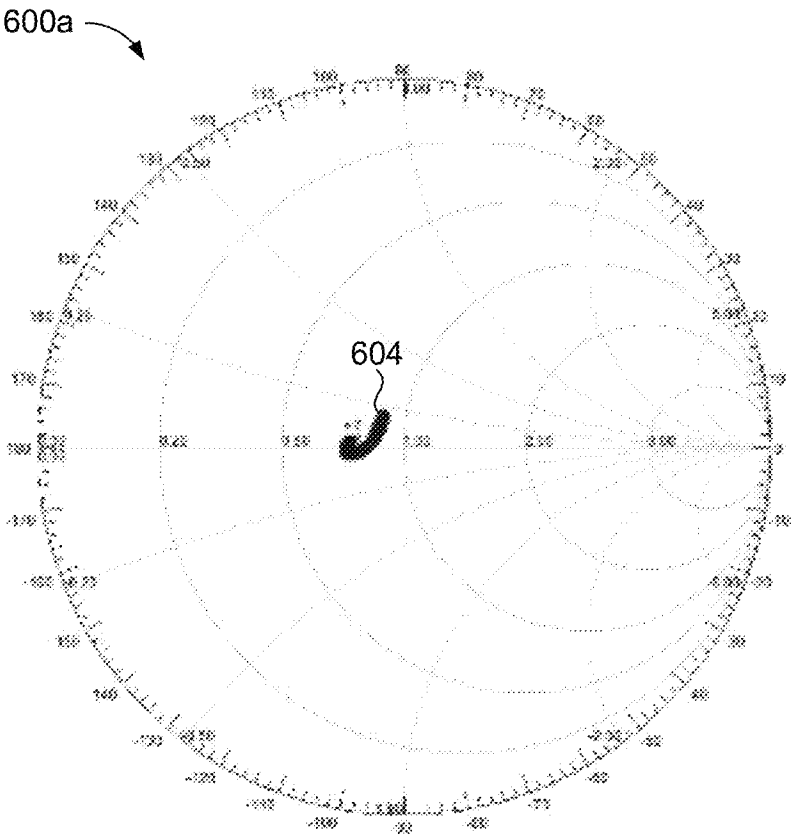
FIG. 6A is an example Smith chart simulating return loss at boresight for the antenna element of FIG. 4.

FIGS. 6A and 6B are exemplary Smith charts 600*a*, 600*b* simulating return loss in the 5 GHz band at boresight for the antenna element 300 of FIG. 3 and the antenna element 400 of FIG. 4. Specifically, the Smith chart 600*a* of FIG. 6A shows a reflection coefficient 604 related to the return loss at boresight for the antenna element 400 without ground vias formed therethrough and the Smith chart 600*b* of FIG. 6B shows a reflection coefficient 602 related to the return loss at boresight for the antenna element 300 having the series of ground vias 320*a-j* formed through the corresponding metal patches 210 in both the horizontal and vertical feeds.

Figure 7B:
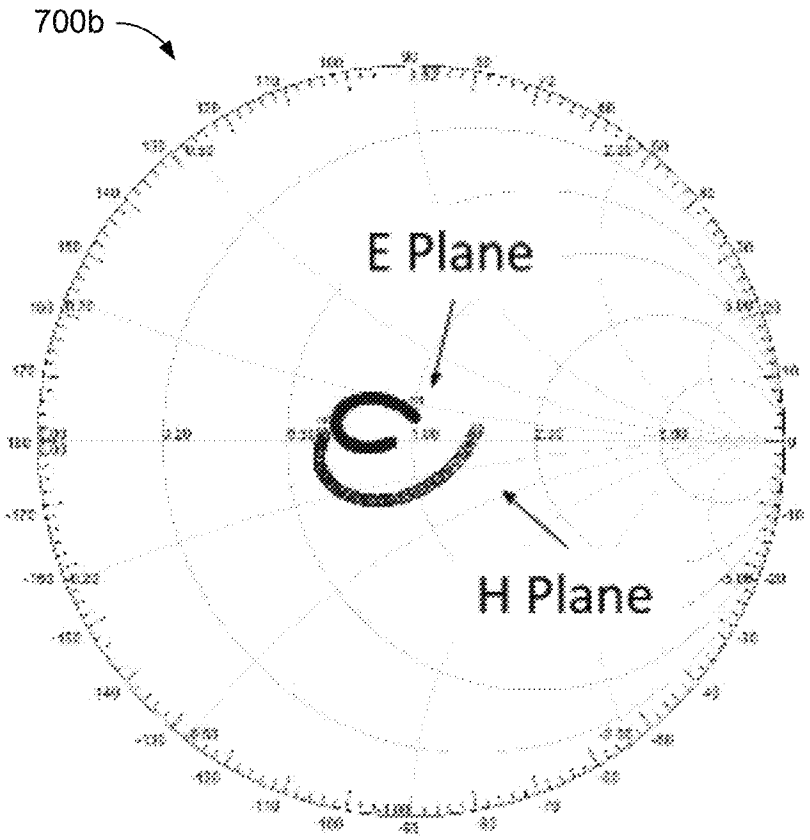
FIG. 7B is an example Smith chart simulating return loss at 45° scan for the antenna element of FIG. 3.
Figure 7A:
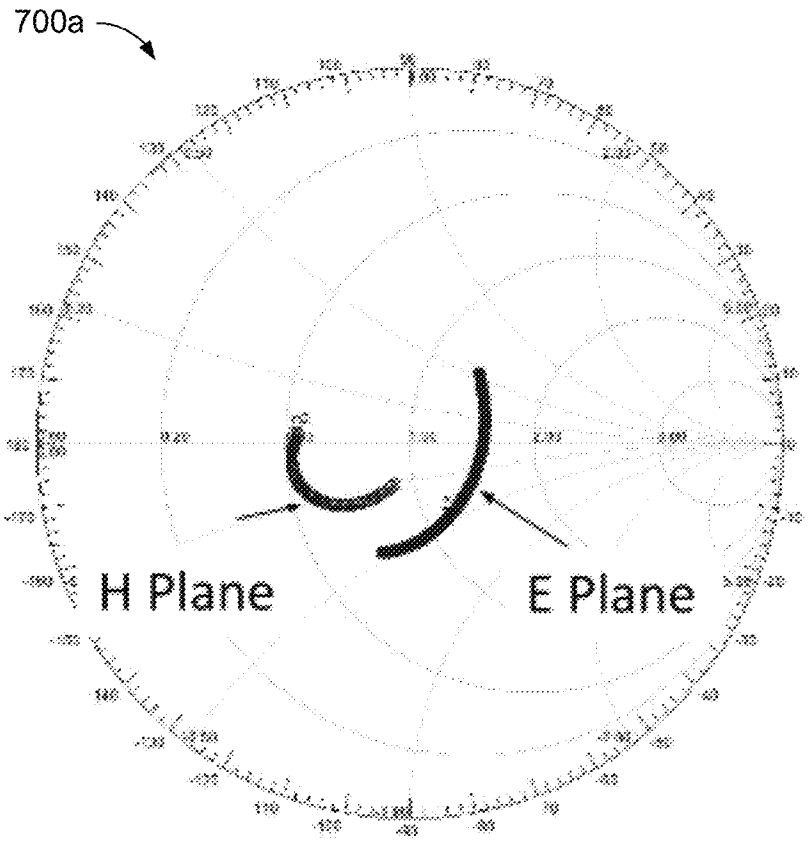
FIG. 7A is an example Smith chart simulating return loss at 45° scan for the antenna element of FIG. 4.

FIGS. 7A and 7B are exemplary Smith charts 700*a*, 700*b* simulating return loss in the 5 GHz band at 45° scan for the antenna element 300 of FIG. 3 and the antenna element 400 of FIG. 4. Specifically, the Smith chart 700*a* of FIG. 7A shows reflection coefficients related to return losses in the H- and E-planes for the antenna element 400 not having ground vias formed therethrough and the Smith chart 700*b* of FIG. 7B shows reflection coefficients related to return losses in the H- and E-planes for the antenna element 300 having the series of ground vias 320*a-j* formed through the corresponding metal patches 210 in both the horizontal and vertical feeds.

Figure 8A:
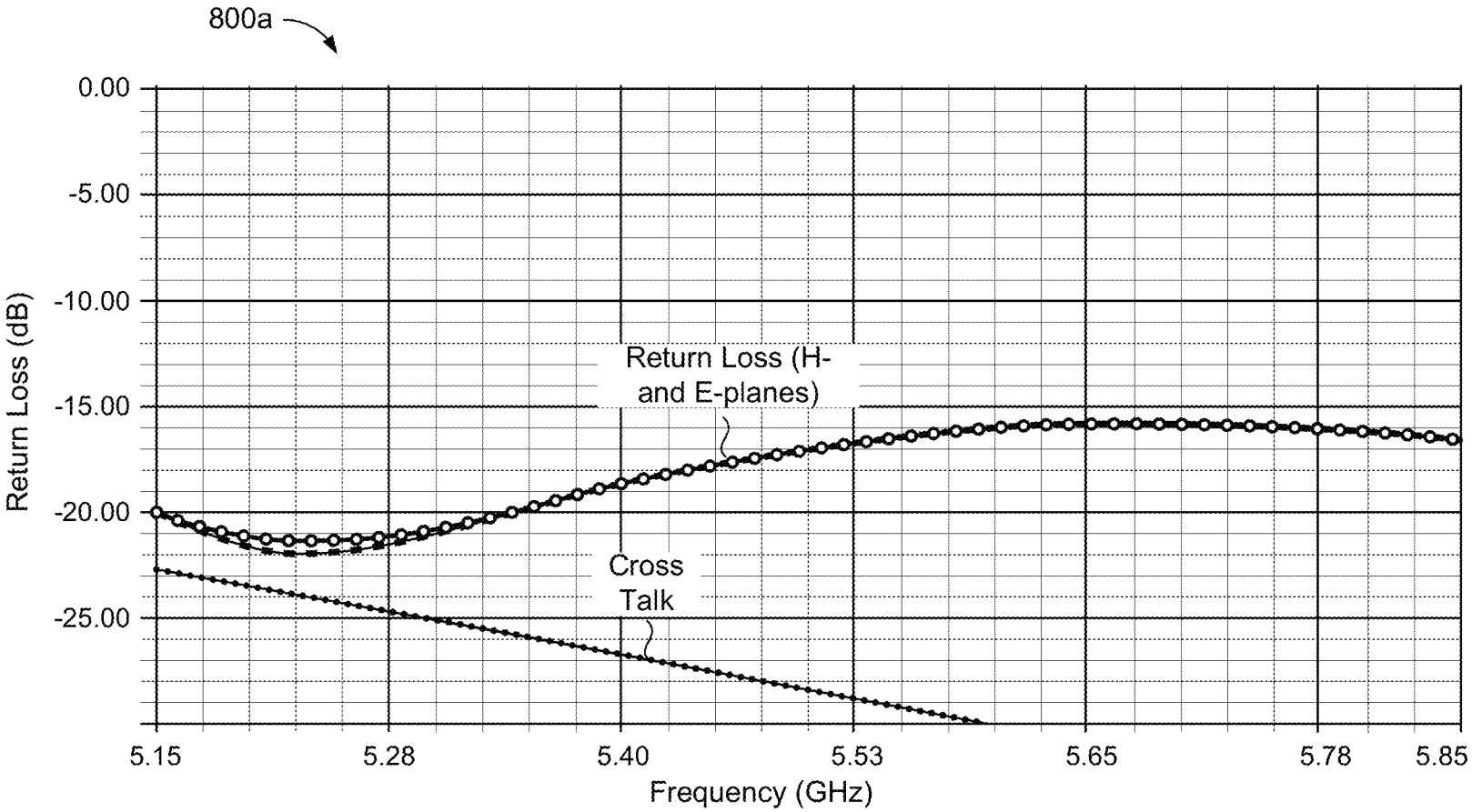
FIG. 8A is an example plot comparing return losses in the H- and E-planes at boresight as a function of frequency for the antenna element of FIG. 4.
Figure 8B:
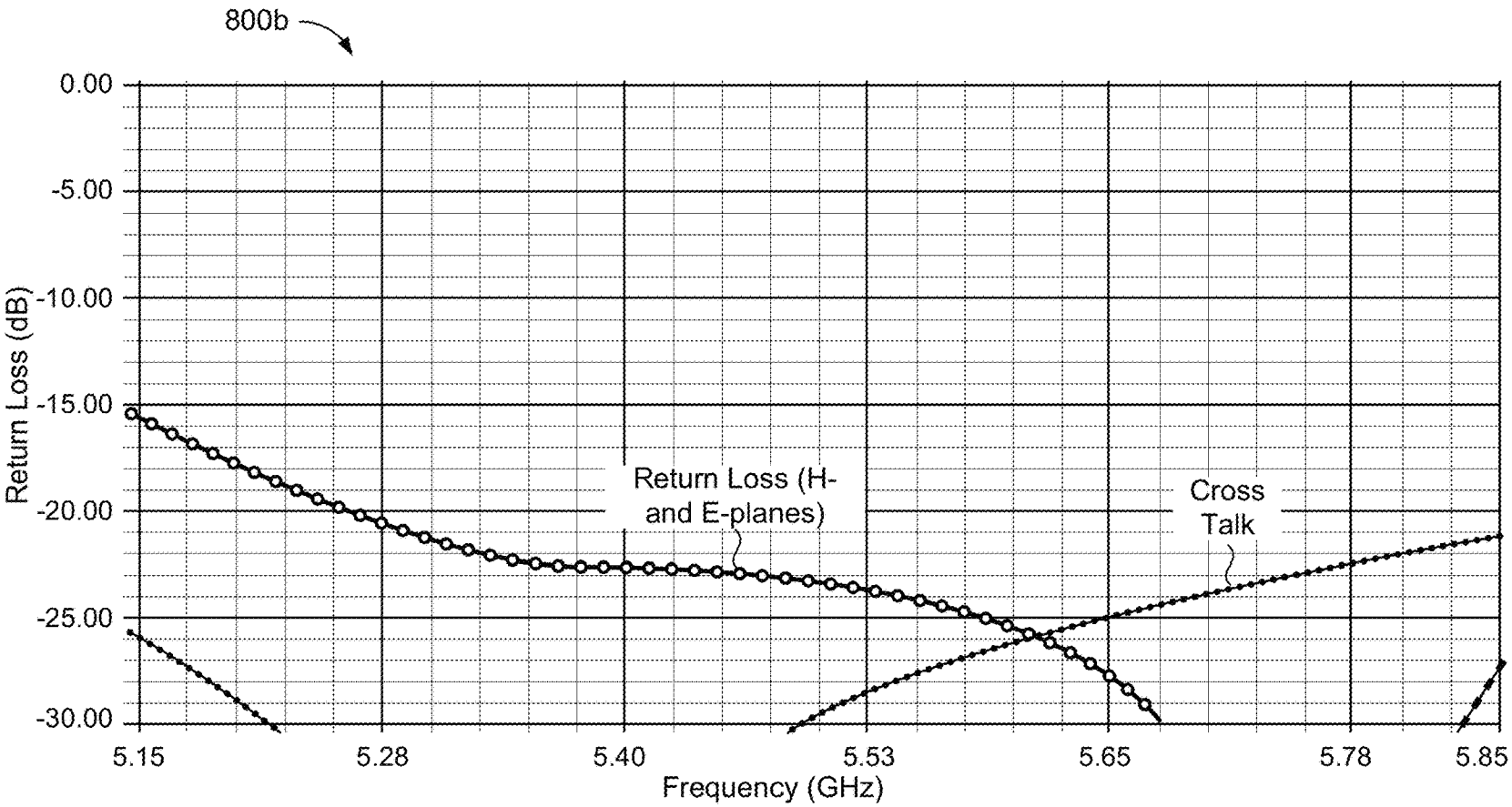
FIG. 8B is an example plot comparing return losses in the H- and E-planes at boresight as a function of frequency for the antenna element of FIG. 3.

FIGS. 8A and 8B are plots 800*a*, 800*b* each comparing return losses in the 5 GHz band at boresight as a function of frequency for both the antenna element 300 of FIG. 3 and the antenna element 400 of FIG. 4. The vertical y-axis denotes simulated return loss (dB) and the horizontal x-axis denotes frequency (GHz) in each of the plots 800*a*, 800*b*. Referring to FIG. 8A, the plot 800*a* compares return losses in the H- and E-planes for the antenna element 400 not having any ground vias 320 formed therethrough. The plot 800*a* also compares cross talk as a function of the frequency. Referring to FIG. 8B, the plot 800*b* similarly compares return losses in the H- and E-planes for the antenna element 300 having the series of ground vias 320*a-j* formed through the corresponding metal patches 310 in both the horizontal and vertical feeds. Plot 800*b* also compares cross talk as a function of the frequency.

Figure 9A:
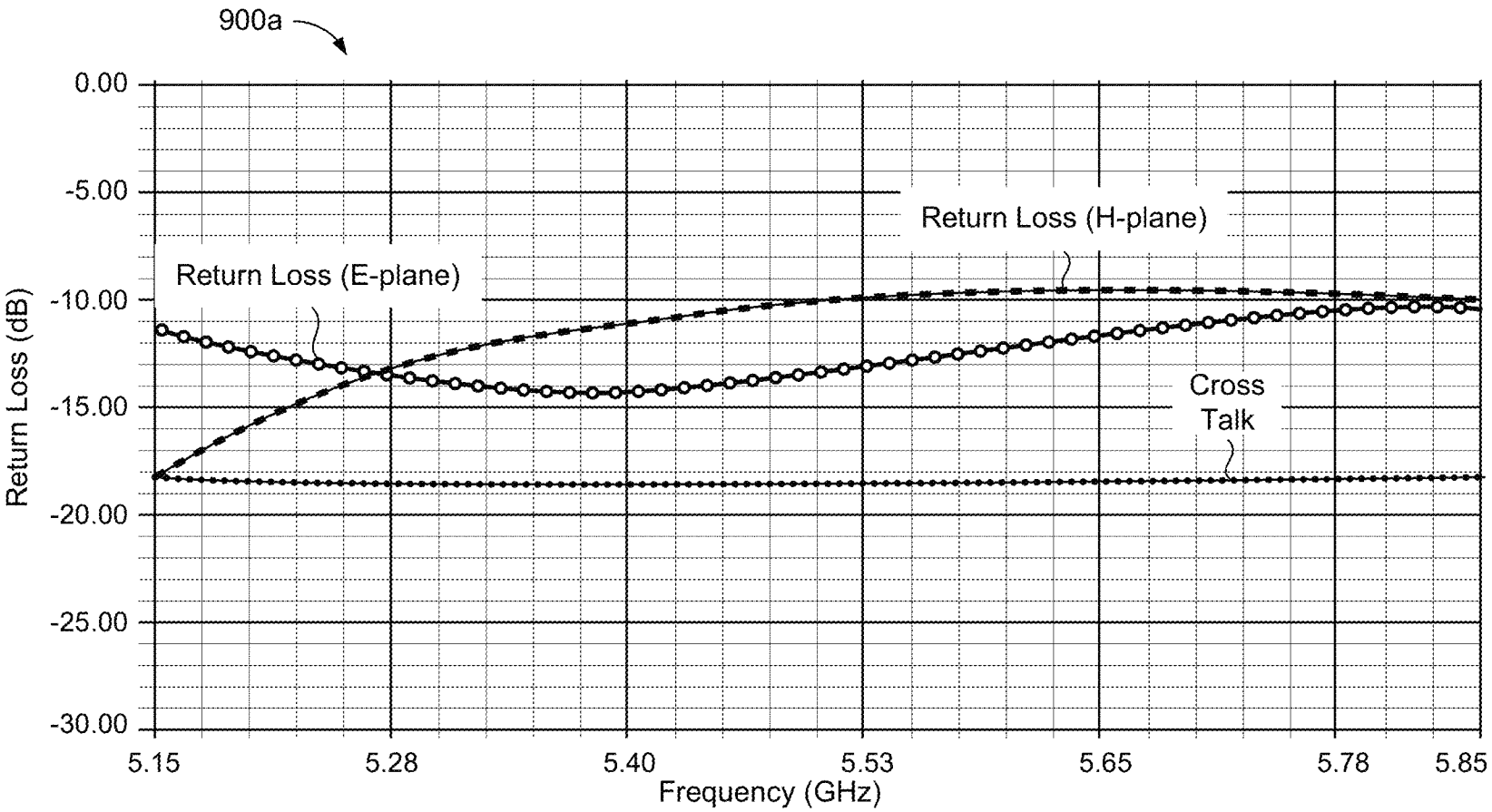
FIG. 9A is an example plot comparing return losses in the H- and E-planes at 45° scan as a function of frequency for the antenna element of FIG. 4.
Figure 9B:
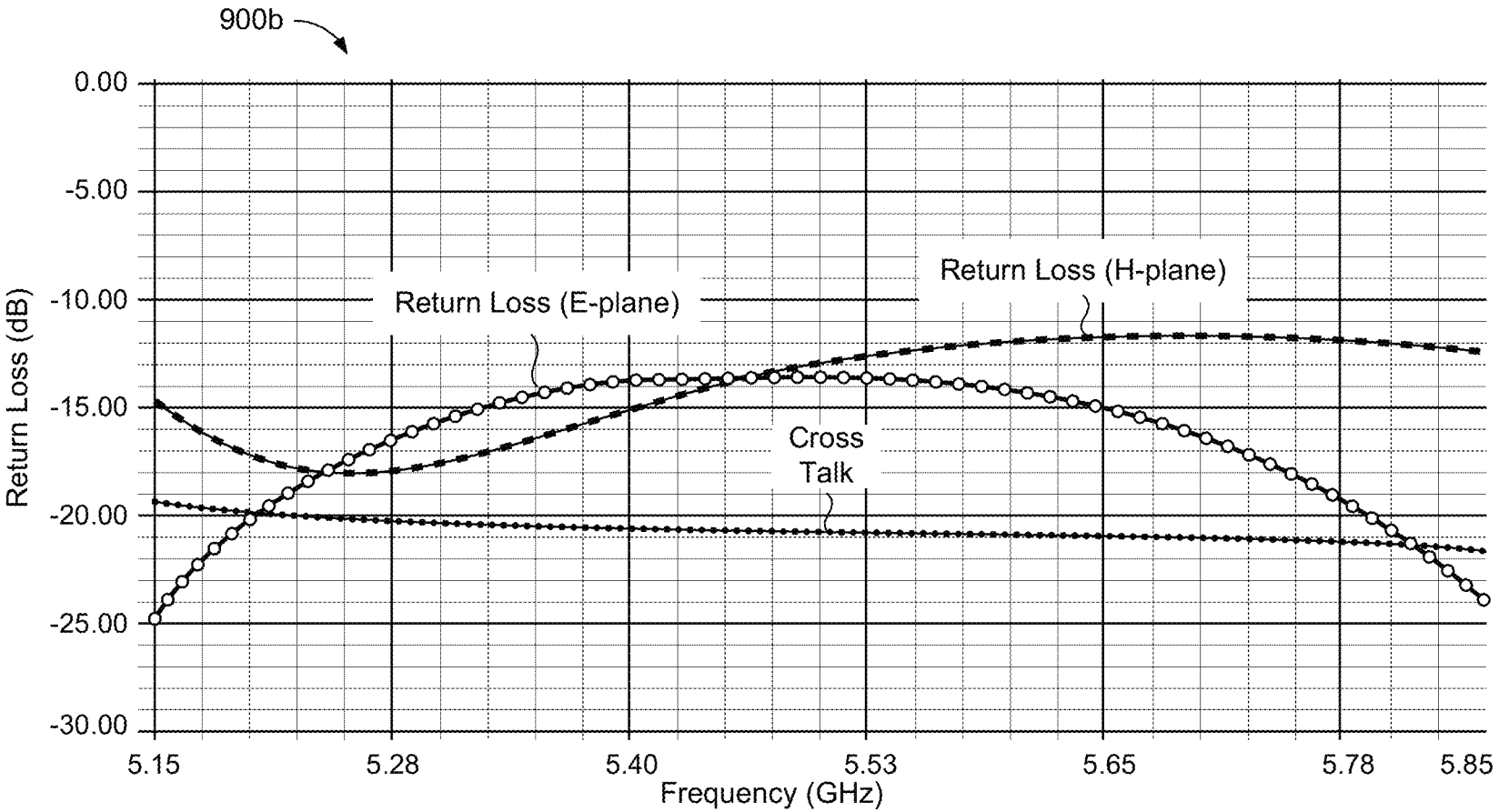
FIG. 9B is an example plot comparing return losses in the H- and E-planes at 45° scan as a function of frequency for the antenna element of FIG. 3.

FIGS. 9A and 9B show plots 900*a*, 900*b* each comparing return loss in the 5 GHz band at 45° scan as a function of frequency for the antenna element 300 of FIG. 3 and the antenna element 400 of FIG. 4. The vertical y-axis denotes simulated return loss (dB) and the horizontal x-axis denotes frequency (GHz) in each of the plots 900*a*, 900*b*. Referring to FIG. 9A, the plot 900*a* compares return losses in both the H-plane and the E-plane for the antenna element 400 not having any ground vias 320 formed therethrough. The plot 900*a* also compares cross talk as a function of the frequency. Referring to FIG. 9B, the plot 900*b* similarly compares return losses in both the H-plane and the E-plane for the antenna element 300 having the series of ground vias 320*a-j* formed through the corresponding metal patches 310 in both the horizontal and vertical feeds. Plot 900*b* also compares cross talk as a function of the frequency.

A number of implementations have been described. Nevertheless, it will be understood that various modifications may be made without departing from the spirit and scope of the disclosure. Accordingly, other implementations are within the scope of the following claims.

What is claimed is:

1. A phased-array antenna assembly, comprising:

an antenna board stack defining a thickness between a bottom end and a top end, the antenna board stack comprising:

a central core layer including a bottom surface and a top surface disposed on an opposite side of the central core layer than the bottom surface, and defining an axis of symmetry bisecting the bottom surface and the top surface to divide the thickness of the antenna board stack in half;

a bottom multilayer antenna unit defining a bottom thickness between the bottom surface of the central core layer and the bottom end of the antenna board stack, the bottom multilayer antenna unit comprising a first bottom metal layer in opposed direct contact with the bottom surface of the central core layer and a second bottom metal layer spaced apart from both the first bottom metal layer and the bottom end of the antenna board stack;

a top multilayer antenna unit defining a top thickness between the top surface of the central core layer and the top end of the antenna board stack, the top multilayer antenna unit comprising two spaced apart top metal layers; and a series of metal-filled ground vias formed through the antenna board stack, the metal-filled ground vias extending in a direction substantially perpendicular to the axis of symmetry and configured to suppress surface waves propagating across the antenna board stack; and a radome configured to cover the top end of the antenna board stack, the radome including an outer surface and an inner surface disposed on an opposite side of the radome than the outer surface and opposing the top end of the antenna board stack.

2. The antenna assembly of claim 1, wherein:

the bottom multilayer antenna unit comprises:

a first bottom dielectric spacer disposed between the first bottom metal layer and the second bottom metal layer; and a second bottom dielectric spacer disposed at the bottom end of the antenna board stack; and the top multilayer antenna unit comprises:

a first top metal layer disposed on the top surface of the central core layer;

a second top metal layer;

a first top dielectric spacer separating the first top metal layer and the second top metal layer; and a second top dielectric spacer disposed on an opposite side of the second top metal layer than the first top dielectric spacer, wherein the first and second bottom metal layers and the first and second top metal layers are connected by at least one probe fed via extending between the top and bottom ends of the antenna board stack.

3. The antenna assembly of claim 2, wherein the first bottom metal layer, the first top metal layer, and the second top metal layer each comprise a corresponding antenna, and the second bottom metal layer comprises a ground plane shared by each of the antennas.

4. The antenna assembly of claim 3, wherein each ground via is formed through a corresponding metal patch of each of the antennas.

5. The antenna assembly of claim 3, wherein a first portion of the ground vias are formed through corresponding metal patches in vertical feeds of the antennas, and a second portion of the ground vias are formed through corresponding metal patches in horizontal feeds of the antennas.

6. The phased-array antenna of claim 5, wherein the number of ground vias in the first portion is equal to the number of ground vias in the second portion.

7. The antenna assembly of claim 2, wherein the metal-filled ground vias are grounded to the second bottom metal layer.

8. The antenna assembly of claim 2, wherein one or more of the metal-filled ground vias are grounded to at least one of the first bottom metal layer, the first top metal layer, or the second top metal layer.

9. The antenna assembly of claim 2, wherein a portion of the metal filling of at least one of the ground vias is removed proximate to the first bottom dielectric spacer to electrically isolate the metal filling from the first bottom dielectric spacer.

10. The antenna assembly of claim 2, wherein each ground via is spaced apart from the at least one probe fed via by at least a predetermined distance to prevent an impedance mismatch.

11. The antenna assembly of claim 2, wherein a radio frequency manifold layer comprising a passive splitter/combiner is formed by a conductive micro-strip line formed on the second bottom dielectric spacer.

12. The antenna assembly of claim 1, wherein the series of metal-filled ground vias formed through the antenna board stack comprises at least ten metal-filled ground vias.

13. The antenna assembly of claim 1, wherein the radome is formed from one or more plastic materials.

14. The antenna assembly of claim 13, wherein the outer surface of the radome is coated with a hydrophobic material.

15. The antenna assembly of claim 1, wherein the radome and the top end of the antenna board stack are separated by a top air gap.

16. The antenna assembly of claim 1, wherein the radome comprises a C-sandwich radome structure.

* * * * *